United States Patent [19]

Burshtain et al.

[11] Patent Number: 4,871,093

[45] Date of Patent: Oct. 3, 1989

[54] CONTAINER FOR DISPENSING A MATERIAL

[76] Inventors: Esther Burshtain; Shlomo Bareket, both of Humlebaekgade 10 st tv, 2200 Copenhagen N, Denmark

[21] Appl. No.: 132,667

[22] Filed: Dec. 10, 1987

Related U.S. Application Data

[63] Continuation of Ser. No. 740,914, filed as PCT DK84/00116 on Nov. 28, 1984, published as WO85/02597 on Jan. 30, 1985, abandoned.

[30] Foreign Application Priority Data

Dec. 14, 1983 [DK] Denmark ..... 83/5758

[51] Int. Cl.[4] ..... B65D 37/00

[52] U.S. Cl. ..... 222/213; 222/196.2; 222/215; 222/490; 222/541; 221/64; 221/302

[58] Field of Search ..... 222/213, 490, 541, 206, 222/215, 494–497, 196.1–196.5, 491, 212; 221/64, 65, 302–310

[56] References Cited

U.S. PATENT DOCUMENTS

| | | | |
|---|---|---|---|
| 1,122,868 | 12/1914 | Davis | 222/490 |
| 1,214,833 | 2/1917 | Schiefer | 222/490 |
| 2,005,642 | 6/1935 | Thornton | 222/490 |
| 2,611,515 | 9/1952 | Smith | 222/213 |
| 2,962,192 | 11/1960 | Volckening | 222/541 |
| 3,184,121 | 5/1965 | Volckening | 222/541 |
| 3,473,705 | 10/1969 | May et al. | 222/541 |
| 3,556,293 | 1/1971 | Schlueter | 221/310 |
| 3,595,446 | 7/1971 | Hellstrom | 222/213 |
| 3,595,467 | 7/1971 | Goglio | 222/494 X |
| 3,687,358 | 8/1972 | Wink et al. | 222/541 |
| 3,935,975 | 2/1976 | Gauntlett | 222/490 |
| 3,986,640 | 10/1976 | Redmond | 222/541 |
| 4,059,201 | 11/1977 | Foster | 222/541 |
| 4,537,326 | 8/1985 | Morehead | 222/541 |

FOREIGN PATENT DOCUMENTS

| | | | |
|---|---|---|---|
| 476898 | 9/1951 | Canada | 222/206 |
| 540083 | 7/1922 | France | 222/206 |
| 729280 | 7/1932 | France | 222/206 |
| 215808 | 5/1924 | United Kingdom | 222/206 |
| 0373641 | 5/1932 | United Kingdom . | |
| 0599184 | 3/1948 | United Kingdom . | |
| 1046518 | 10/1966 | United Kingdom . | |
| 2102398 | 2/1983 | United Kingdom . | |

*Primary Examiner*—Kevin P. Shaver
*Assistant Examiner*—David H. Bollinger
*Attorney, Agent, or Firm*—Laubscher, Presta & Laubscher

[57] ABSTRACT

A dispensing container formed of flexible material includes a dispensing aperture through which material is dispensed upon manipulation of the container to open the dispensing aperture. A dispensing-sheet composed of an elastically resilient material includes slits which form the dispensing aperture. The dispensing-sheet is attached to the interior surface of the container and is initially covered by a removable portion of the container.

8 Claims, 1 Drawing Sheet

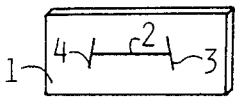
Fig. 1a
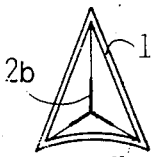
Fig. 1b
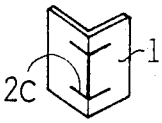
Fig. 1c
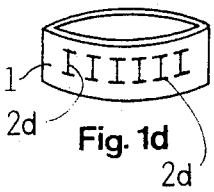
Fig. 1d
Fig. 1e
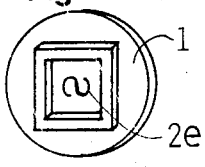
Fig. 1f
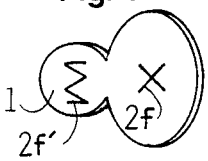
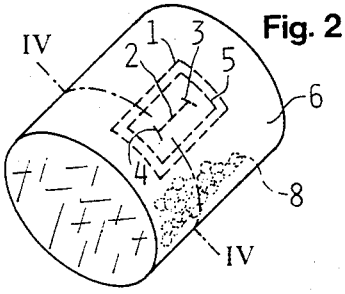
Fig. 2
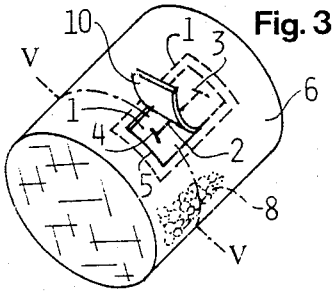
Fig. 3
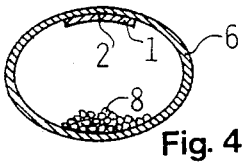
Fig. 4
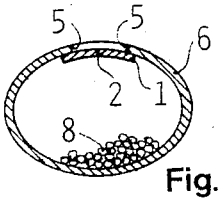
Fig. 5
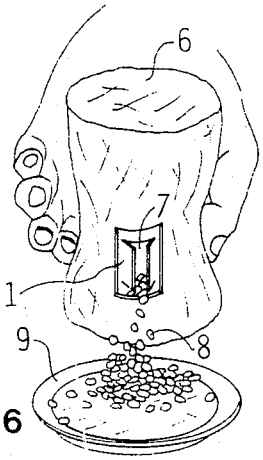
Fig. 6

CONTAINER FOR DISPENSING A MATERIAL

This application is a continuation of application Ser. No. 06/740,914, filed as PCT DT84/00116 on Nov. 28, 1984, published as WO85/02597 on Jun. 20, 1985, now abandoned.

The invention relates to a container consisting of flexible material and having a wall portion which formed with protected slit which is designed to form a dispensing aperture and automatic closure by manipulation of the container, after the first time the container has been opened by the first user of the contents of the container.

Such containers can be used for transport and storing products differing widely in nature, not only solid materials, such as sweets, pills and powder, but also fluid and semi-fluid materials, such as cream or paste. To dispense a major or minor portion of the contents, the container simply manipulated by such pressure on its as will cause the slit to open more or less in a manner enabling easy metering. The container will autmoatically close again on release of the pressure.

BRIEF DESCRIPTION OF THE PRIOR ART

U.S. Pat. No. 2 611 515 discloses a container of the present type, which has a rounded top member in which the slit is provided and which has internal reinforcements around the slit. On the exterior of the top member the slit may be coated with a thin layer of lacquer or the like, which seals the slit hermetically until it is subject to an opening pressure the first time which ruptures the lacquer coating. However, there is a considerable risk that the container will inadvertently be subjected to such a pressure during transport and storage before reaching the first user, or that the lacquer coating will be removed or damaged by chemical or thermal action.

SUMMARY OF THE INVENTION

The principal object of the present invention is to provide a new and inexpensive container, employing the principle of action disclosed in U.S. Pat. No. 2 611 515, and which is effectively protected against inadvertent opening during transport and storage and which makes it possible to ascertain with certainty whether it has been opened before.

Another object of the invention is to provide a container with a dispenser-unit which is protected from touching and dirt after filling and sealing, and against damage during transport and storage until the first opening, without addition of material to the exterior side of the container.

Another object of the invention is to make it possible to produce some of such containers during filling and sealing.

Those objects are achieved in that the wall portion, which in addition to the flexible-material of the container, also comprises of a flexible dispensing-sheet which is formed with the slit and which is a part of the dispenser-unit which is attached to the inner of the body of the container which is comprising of the flexible-material. Thus, the first user of the contents of such container has to break somehow the flexible material of the wall portion to gain access to the clean and protected dispenser-unit which is a part of the inner side of the said wall portion. Such breaking cannot be performed without leaving visual signs of it on the container.

The flexible-material of the body of the container is preferably plastic foil, but may also be of other flexible material, such e.g. paper, cardbord, metal foil, textile and may optionally be of an elastic material, such as e.g. rubber and may of course, be of more then one layer.

The dispenser-unit of the container comprises of at least one dispensing-sheet of comprising at least one sheet of elastically resilient material which is formed with at least one slit.

As mentioned, the dispenser-sheet, which is not necessarily flat, may also be of more than one part and of more than one layer which are not necessarily of same material and are not necessarily formed with same periphery of slit as the sheet of elastically resilient material.

The first opening of the container is effected, e.g. by mean of a cutting tool or otherwise, or by removing part of the flexible-material of the wall portion which is of the flexible material of the container and which may be marked, within the periphery of the dispenser-unit which is attached to the flexble material of the container and which is formed with the slit. Another way of opening the container for the first time is by cutting through the container opposite the slit in the dispenser-unit which may be marked on the container.

When the container is opened for the first time, part of the container flexible material within the area defined by the dispenser-sheet is ruptured, so that a part of the dispenser-unit which is formed with the slit is exposed and is between the inside and outside of the container which is closed by the remaining part of the wall portion.

When the dispensing-sheet is then bent, the slit edges are moved apart to form the dispensing aperture. The dispensing aperture is automatically closed again on release of the dispensing-sheet which straightens because of the elasticity of the sheet of elastically resilient material, when the slit edges meet again. The container flexible material is permanently ruptured so it is easy to ascertain that the container has been opened before. It is not necessary to coat the exposed slit with other material to close the container after the exposure of the said slit.

BRIEF DESCRIPTION OF THE FIGURES

The invention will be described more fully below with reference to the drawing, in which FIGS. 1*a* to 1*f* show in perspective view, a plurality of embodiments of one-part dispensing-sheet which is used in the containers of the invention, and which is of elastically resilient material. FIG. 1*d* shows embodiment of two layers sheet which are of same material and FIG. 1*e* shows embodiment of two layers sheet which are differing in material and periphery.

FIGS. 1*a* to 1*f* show also a plurality of embodiments of slits 2,3 and 4 and slits 2*b*, 2*c*, 2*d*, 2*e*, 2*f* and 2*f* in dispensing-sheet 1. Of course, other slit embodiments in the sheet 1 are possible, but they share the feature that the slit edges are moved apart when the sheet 1 is bent from its rest position, in which it is not necessarily flat, and are moved together again when the sheet 1 reassumes its rest position because of the elasticity of the material. Other slit embodiments are, of course, possible in other embodiments of the dispensing-sheet which are not shown.

FIG. 2 shows in perspective view, an embodiment of the closed and sealed container of the invention which is filled with products such as pills, and which consists of one layer of flexible foil material, and where the dispenser-unit incorporated inside the container consists of only one layer sheet of elastically resilient material which is the preferred dispensing-sheet shown in FIG. 1*a*, FIG. 3 is a perspective view of the container of FIG. 2 after partial exposure of its dispenser-sheet and its slit, FIG. 4 is a cross-section of the container and its dispensing-sheet along the line IV—IV in FIG. 2, FIG. 5 is a cross-section of the container and its dispensing-sheet along the line V—V in FIG. 3, and FIG. 6 is a perspective view of the container of FIG. 3 after full exposure of its slit, during dispensing of material through the dispensing aperture.

DETAILED DESCRIPTION

As mentioned, the container 6 shown in FIG. 2, consists of one layer flexible foil material. The embodiment in FIG. 1*a* of the dispensing-sheet 1, which has a rectilinear slit 2 and slits 3 and 4 at either end of the slit 2 transverse to the slit 2, is attached as shown in FIG. 2, e.g. by adhesion, to the inner side of the container 6 within the periphery of the dispensing-sheet 1. The container 6 has weakened lines 5, e.g. in the form of perforations, to facilitate removal of the flexible material of the container 6 within the area defined by the dispensing-sheet 1 so that the slits 2, 3 and 4 are exposed.

The partially removed-part 10 of the flexible material within the weakened lines 5 is shown most clearly in FIG. 3.

As mentioned, FIG. 4 shows a cross-section through the container 6 along the line IV—IV in FIG. 2. The figures show the dispensing-sheet 1, protected from touching and dirt, in the hermetically sealed container 6 which has not been opened before.

FIG. 5 shows the cross-section through the container 6 along line V—V in FIG. 3. Here, the flexible material of the container 6 within the weakened lines 5 is removed, and it cannot be reapplied without leaving visible sign of this.

FIG. 6 shows the container 6 with opened dispensing aperture 7, from which material in form of pills 8 is dispensed and falls on plate 9.

To facilitate the first opening 7 of the container 6, in order to use the dispenser-unit 1 and to indicate its location on the inner side of the container 6, the weakened lines 5 which may be visual, is formed within the periphery of the dispenser-unit 1, in the flexible material of the container 6. The weakened line 5 may be comprised of or made of thinner material. It may of course be feelable and may consist of perforations as multicombination or by each way disclosed above.

By tearing the flexible material 10 of the container 6 along the line 5, the first user will reach the slits 2, 3 and 4 without any risk of damaging the dispenser-unit which consists of dispensing-sheet 1 or opening the container 6 behind the dispenser-unit 1.

A visual mark may also indicate or instruct the user where and how to remove the flexible material 10 and dispense the container.

We claim:

1. A container, comprising (a) a housing formed of flexible material and having at least one wall portion;

(b) said wall portion including at least one internal dispenser unit connected with at least one inner side surface of said wall portion, said dispenser unit extending in contiguous relation with said wall portion and comprising at least one flexible dispenser sheet of elastically resilient material;

(c) said dispenser sheet containing at least one slit which defines a dispensing aperture which opens upon manipulation of said housing to dispense the contents of the housing and which automatically closes after dispensing; and (d) said housing wall-portion containing at least one weakened line within the periphery of said dispenser sheet to define an impassable unbroken layer of flexible material integrally connected with said housing, said layer being at least partially removable to expose said dispensing slit.

2. A container according to claim 1, characterized in that said removable layer is thinner at at least part of said weakened line.

3. A container according to claim 1, characterized in that at least part of said weakened line consists of perforations.

4. A container according to claim 1, characterized in that at least part of one said weakened line is visually marked.

5. A container for dispensing particulate flowable materials, comprising (a) a housing formed of flexible material and having first and second end walls interconnected by a body side wall, said housing containing a supply of particulate flowable material of less volume than the volume of said container;

(b) said body side wall including a removable portion for defining an opening in said side wall, said removable portion being formed by a weakened line in said body side wall; and (c) a resilient dispensing sheet secured to the interior of said body side wall and extending beyond the periphery of said opening defined by removal of said removable portion, said resilient dispensing sheet containing at least one slit therethrough and positioned below said removable portion, whereby upon removal of said removable portion and upon manual manipulation to flex said body side wall immediately adjacent and on each side of said resilient dispensing sheet, said slit may be opened and flowable particulate material dispensed from the container.

6. A container as defined in claim 5, wherein said flexible material of said body side wall is thinner in the region of said weakened line of perforations.

7. A container as defined in claim 6, and further comprising a visual indication on said removable portion corresponding with said weakened line of perforations.

8. A container as defined in claim 6, and further comprising a tactile indication on said removable portion corresponding with the location of said slit.

* * * * *